US006264078B1

(12) United States Patent
Bilang

(10) Patent No.: US 6,264,078 B1
(45) Date of Patent: Jul. 24, 2001

(54) COMBINATION SPORTS BAG AND CHAIR ASSEMBLY

(76) Inventor: Armando Bilang, 573-B Estates St., Livermore, CA (US) 94550

( * ) Notice: Subject to any disclaimer, the term of this patent is extended or adjusted under 35 U.S.C. 154(b) by 0 days.

(21) Appl. No.: 09/545,899

(22) Filed: Apr. 8, 2000

(51) Int. Cl.[7] ..... A45F 4/02

(52) U.S. Cl. ..... 224/155; 297/54; 297/188.07; 297/129

(58) Field of Search ..... 224/153, 155, 224/156, 575, 576, 577; 297/129, 54, 46, 47, 228.1, 188.2, 188.06, 188.07

(56) References Cited

U.S. PATENT DOCUMENTS

| | | | | |
|---|---|---|---|---|
| 2,816,599 | | 12/1957 | Adams . | |
| 3,151,909 | * | 10/1964 | Gerdetz | 224/155 X |
| 3,580,633 | * | 5/1971 | Du Priest | 297/188.2 X |
| 4,273,221 | | 6/1981 | Poag | 190/8 |
| 4,487,345 | | 12/1984 | Pierce | 224/155 |
| 4,892,353 | * | 1/1990 | Goddard | 297/188.2 X |
| 4,942,948 | | 7/1990 | Vickers | 190/8 |
| 5,016,792 | * | 5/1991 | Jay | 224/155 |
| 5,209,381 | * | 5/1993 | Jay | 224/155 |
| 5,289,958 | * | 3/1994 | Jay | 224/155 |
| 5,326,152 | * | 7/1994 | Baron | 297/228.1 X |
| 5,803,539 | * | 9/1998 | Dewar et al. | 297/228.1 X |

FOREIGN PATENT DOCUMENTS

| | | | | |
|---|---|---|---|---|
| 2825366 | * | 12/1979 | (DE) | 224/155 |

* cited by examiner

*Primary Examiner*—Gregory Vidovich
(74) *Attorney, Agent, or Firm*—Goldstein Law Offices P.C

(57) ABSTRACT

A combination sports bag and chair assembly including a seat portion comprised of a frame. The frame includes a plurality of seat straps extending thereover. The seat portion is contained within a bag portion. The bag portion includes a forward edge and a rearward edge. The forward edge has a zippered opening. A seat back portion is foldably coupled with respect to the seat portion. The seat back portion is comprised of a frame. The frame includes a plurality of straps extending thereover. The frame of the seat back portion is foldably coupled with the frame of the seat portion. The seat back portion is contained within a bag portion. The bag portion has a top edge and a bottom edge. The top edge has a zippered opening.

6 Claims, 2 Drawing Sheets

COMBINATION SPORTS BAG AND CHAIR ASSEMBLY

BACKGROUND OF THE INVENTION

The present invention relates to a combination sports bag and chair assembly and more particularly pertains to allowing for an assortment of articles to be carried with a foldable chair.

The use of combination chair devices is known in the prior art. More specifically, combination chair devices heretofore devised and utilized for the purpose of combining folding chairs with other functions are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,273,221 to Poag discloses a combination suitcase having walls and side panels that provide a backrest to the user. U.S. Pat. No. 4,942,948 to Vickers discloses a combination beach bag and recliner chair. U.S. Pat. No. 4,487,345 to Pierce discloses a backpack with a foldable chair assembly. U.S. Pat. No. 2,816,599 to Adams discloses an additional support device combined with a bag.

While these devices fulfill their respective, particular objective and requirements, the aforementioned patents do not describe a combination sports bag and chair assembly for allowing for an assortment of articles to be carried with a foldable chair.

In this respect, the combination sports bag and chair assembly according to the present invention substantially departs from the conventional concepts and designs of the prior art, and in doing so provides an apparatus primarily developed for the purpose of allowing for an assortment of articles to be carried with a foldable chair.

Therefore, it can be appreciated that there exists a continuing need for a new and improved combination sports bag and chair assembly which can be used for allowing for an assortment of articles to be carried with a foldable chair. In this regard, the present invention substantially fulfills this need.

SUMMARY OF THE INVENTION

In the view of the foregoing disadvantages inherent in the known types of combination chair devices now present in the prior art, the present invention provides an improved combination sports bag and chair assembly. As such, the general purpose of the present invention, which will be described subsequently in greater detail, is to provide a new and improved combination sports bag and chair assembly which has all the advantages of the prior art and none of the disadvantages.

To attain this, the present invention essentially comprises a seat portion comprised of a frame. The frame has a generally D-shaped configuration. The frame includes a plurality of seat straps extending thereover. The seat portion is contained within a bag portion. The bag portion includes a forward edge and a rearward edge. The forward edge has a zippered opening. The bag portion includes a pair of carrying handles secured thereto. The seat portion includes a pair of U-shaped legs foldably coupled to the frame. The bag portion has a pair of clips secured to the rearward edge thereof. The bag portion has a single clip secured to the forward edge thereof. A seat back portion is foldably coupled with respect to the seat portion. The seat back portion is comprised of a frame. The frame includes a plurality of straps extending thereover. The frame of the seat back portion is foldably coupled with the frame of the seat portion. The seat back portion is contained within a bag portion. The bag portion has a top edge and a bottom edge. The top edge has a zippered opening. A carrying strap is couplable with the pair of clips of the rearward edge and the pair of clip of the forward edge of the bag portion of the seat portion.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved combination sports bag and chair assembly which has all the advantages of the prior art combination chair devices and none of the disadvantages.

It is another object of the present invention to provide a new and improved combination sports bag and chair assembly which may be easily and efficiently manufactured and marketed.

It is a further object of the present invention to provide a new and improved combination sports bag and chair assembly which is of durable and reliable construction.

An even further object of the present invention is to provide a new and improved combination sports bag and chair assembly which is susceptible of a low cost of manufacture with regard to both materials and labor, and which accordingly is then susceptible of low prices of sale to the consuming public, thereby making such a combination sports bag and chair assembly economically available to the buying public.

Even still another object of the present invention is to provide a new and improved combination sports bag and chair assembly for allowing for an assortment of articles to be carried with a foldable chair.

Lastly, it is an object of the present invention to provide a new and improved combination sports bag and chair assembly including a seat portion comprised of a frame. The frame has a generally D-shaped configuration. The frame includes a plurality of seat straps extending thereover. The seat portion is contained within a bag portion. The bag portion includes a forward edge and a rearward edge. The forward edge has a zippered opening. A seat back portion is foldably coupled with respect to the seat portion. The seat back portion is comprised of a frame. The frame includes a plurality of straps extending thereover. The frame of the seat back portion is foldably coupled with the frame of the seat portion. The seat back portion is contained within a bag portion. The bag portion has a top edge and a bottom edge. The top edge has a zippered opening.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 2:
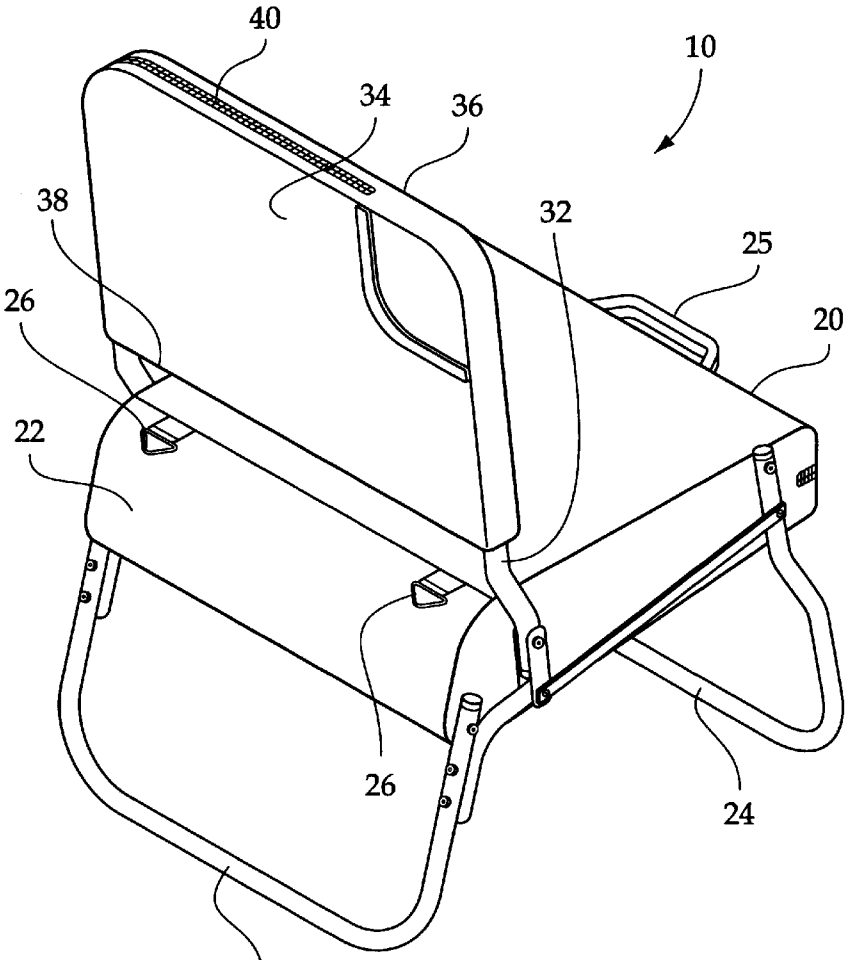
FIG. 2 is a perspective view of the present invention illustrated in an unfolded orientation.
Figure 1:
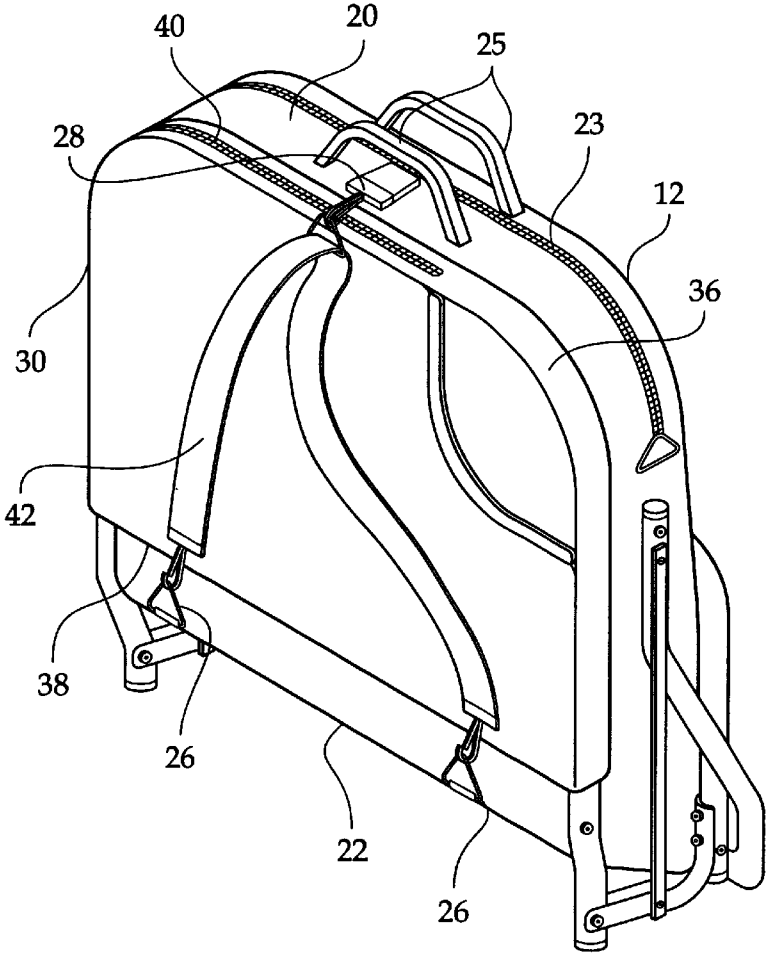
FIG. 1 is a perspective view of the preferred embodiment of the combination sports bag and chair assembly constructed in accordance with the principles of the present invention.
Figure 3:
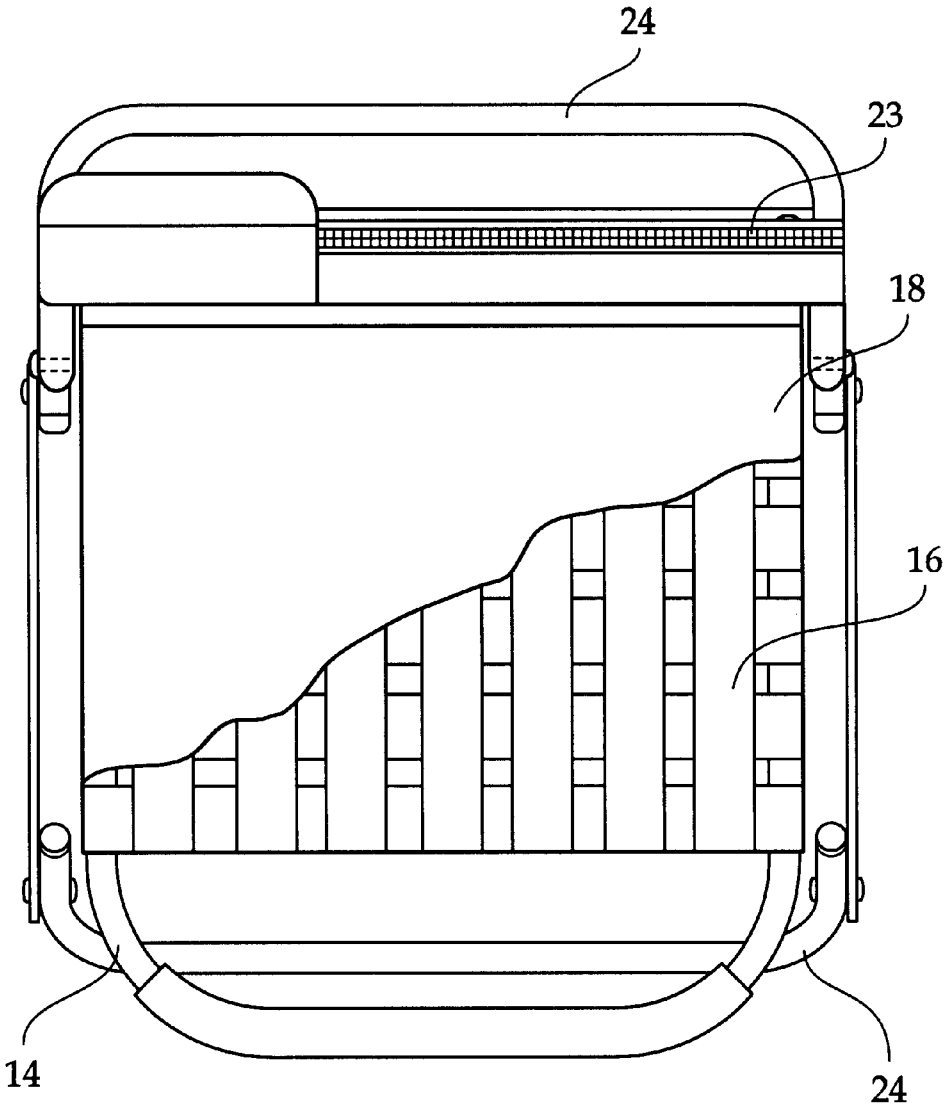
FIG. 3 is a bottom plan view of the present invention.

With reference now to the drawings, and in particular, to FIGS. 1 through 3 thereof, the preferred embodiment of the new and improved combination sports bag and chair assembly embodying the principles and concepts of the present invention and generally designated by the reference number 10 will be described.

Specifically, it will be noted in the various Figures that the device relates to a combination sports bag and chair assembly for allowing for an assortment of articles to be carried with a foldable chair. In its broadest context, the device consists of a seat portion, a seat back portion, and a carrying strap. Such components are individually configured and correlated with respect to each other so as to attain the desired objective.

The seat portion 12 is comprised of a frame 14. The frame 14 has a generally D-shaped configuration. The frame 14 includes a plurality of seat straps 16 extending thereover. The seat portion 12 is contained within a bag portion 18. The bag portion 18 includes a forward edge 20 and a rearward edge 22. The forward edge has a zippered opening 23. The bag portion 18 includes a pair of carrying handles 25 secured thereto. The seat portion includes a pair of U-shaped legs 24 foldably coupled to the frame. The bag portion 18 has a pair of clips 26 secured to the rearward edge 22 thereof. The bag portion 18 has a single clip 28 secured to the forward edge 20 thereof.

The seat back portion 30 is foldably coupled with respect to the seat portion 12. The seat back portion 30 is comprised of a frame 32. The frame 32 includes a plurality of straps extending thereover. The frame 32 of the seat back portion 30 is foldably coupled with the frame 14 of the seat portion 12. The seat back portion 30 is contained within a bag portion 34. The bag portion 34 has a top edge 36 and a bottom edge 38. The top edge 38 has a zippered opening 40.

The carrying strap 42 is couplable with the pair of clips 26 of the rearward edge 22 and the single of clip 28 of the forward edge 20 of the bag portion 18 of the seat portion 12. The carrying strap 42 allows for the present invention to be easily carried.

In use, the present invention operates in a manner similar to folding beach chairs. However, the present invention incorporates two bag portions 18,34 that covers the straps that normally support a person when sitting. The bag portions 18,34 are both provided with zippered openings 23,40 that allow for all types of items to be stored therein during transportation. These items can be removed once a destination has been reached so that the present invention can be unfolded and used as a seat.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A combination sports bag and chair assembly for allowing for an assortment of articles to be carried with a foldable chair comprising, in combination:

a seat portion comprised of a frame, the frame having a generally D-shaped configuration, the frame including a plurality of seat straps extending thereover, the seat portion being contained within a bag portion, the bag portion including a forward edge and a rearward edge, the forward edge having a zippered opening, the bag portion including a pair of carrying handles secured thereto, the seat portion including a pair of U-shaped legs foldably coupled to the frame, the bag portion having a pair of clips secured to the rearward edge thereof, the bag portion having a single clip secured to the forward edge thereof;

a seat back portion foldably coupled with respect to the seat portion, the seat back portion comprised of a frame, the frame including a plurality of straps extending thereover, the frame of the seat back portion being foldably coupled with the frame of the seat portion, the seat back portion being contained within a bag portion, the bag portion having a top edge and a bottom edge, the top edge having a zippered opening;

a carrying strap couplable with the pair of clips of the rearward edge and the pair of clip of the forward edge of the bag portion of the seat portion.

2. A combination sports bag and chair assembly for allowing for an assortment of articles to be carried with a foldable chair comprising, in combination:

a seat portion comprised of a frame, the frame including a plurality of seat straps extending thereover, the seat portion being contained within a bag portion, the bag portion including a forward edge and a rearward edge, the forward edge having a zippered opening;

a seat back portion foldably coupled with respect to the seat portion, the seat back portion comprised of a frame, the frame including a plurality of straps extending thereover, the frame of the seat back portion being foldably coupled with the frame of the seat portion, the seat back portion being contained within a bag portion, the bag portion having a top edge and a bottom edge, the top edge having a zippered opening.

3. The combination sports bag and chair assembly as set forth in claim 2 wherein the bag portion of the seat portion includes a pair of carrying handles secured thereto.

4. The combination sports bag and chair assembly as set forth in claim 2 wherein the seat portion includes a pair of U-shaped legs foldably coupled to the frame thereof.

5. The combination sports bag and chair assembly as set forth in claim 2 wherein the bag portion of the seat portion has a pair of clips secured to the rearward edge thereof and a single clip secured to the forward edge thereof.

6. The combination sports bag and chair assembly as set forth in claim 5 and further including a carrying strap couplable with the pair of clips of the rearward edge and the pair of clip of the forward edge of the bag portion of the seat portion.

* * * * *